US009828721B2

(12) United States Patent
Silverman et al.

(10) Patent No.: US 9,828,721 B2
(45) Date of Patent: Nov. 28, 2017

(54) COLLAPSIBLE LAUNDRY HAMPER

(71) Applicant: Butler Home Products, LLC, Marlborough, MA (US)

(72) Inventors: Michael Silverman, Westborough, MA (US); Robert Cavalcanti, Marlborough, MA (US); Robert Ashworth, Littleton, MA (US)

(73) Assignee: Butler Home Products, LLC, Marlborough, MA (US)

( * ) Notice: Subject to any disclaimer, the term of this patent is extended or adjusted under 35 U.S.C. 154(b) by 0 days.

(21) Appl. No.: 14/966,255

(22) Filed: Dec. 11, 2015

(65) Prior Publication Data

US 2016/0167832 A1 Jun. 16, 2016

Related U.S. Application Data

(60) Provisional application No. 62/090,946, filed on Dec. 12, 2014.

(51) Int. Cl.
*D06F 95/00* (2006.01)
*B65D 33/02* (2006.01)

(52) U.S. Cl.
CPC ..... *D06F 95/004* (2013.01); *D06F 95/002* (2013.01); *B65D 33/02* (2013.01)

(58) Field of Classification Search
USPC ..... 220/9.1, 9.2, 6, 666; 135/125; 383/117, 383/119, 105, 40, 14, 16, 28, 41, 66; 190/107, 115
See application file for complete search history.

(56) References Cited

U.S. PATENT DOCUMENTS 2,625,973 A * 1/1953 Weldon ..... D06F 95/004 206/459.5
5,116,138 A * 5/1992 Macsenti ..... A47F 3/14 220/9.2
5,467,794 A * 11/1995 Zheng ..... A63B 9/00 135/117
D373,073 S 8/1996 Kellogg
5,560,385 A 10/1996 Zheng
D380,326 S 7/1997 Kellogg et al.
5,816,279 A 10/1998 Zheng
D406,423 S * 3/1999 Kellogg ..... D32/36
5,941,265 A 8/1999 Zheng
5,964,533 A * 10/1999 Ziglar ..... D06F 95/002 220/9.2
5,971,188 A 10/1999 Kellogg et al.
(Continued)

*Primary Examiner* — J. Gregory Pickett
*Assistant Examiner* — Gideon Weinerth
(74) *Attorney, Agent, or Firm* — McCarter & English, LLP

(57) ABSTRACT

A collapsible container is provided having an outer liner defining a top, a bottom and vertical sides and an inner liner defining a plurality of sides corresponding to the vertical sides of the outer liner. The inner liner is attached to the outer liner at least at one of the top and the bottom of the outer liner, and each side of the inner liner defines a top edge, a bottom edge, and two side edges which extend vertically. A sleeve is attached to each of the edges of the inner liner at the top, bottom, and sides thereof. The sleeves define substantially circular tubes. A flexible frame is located between the outer liner and the inner liner and disposed within the plurality of sleeves to provide a flexible support and permits collapse and/or folding of the container.

9 Claims, 4 Drawing Sheets

(56) References Cited

U.S. PATENT DOCUMENTS 5,992,045 A 11/1999 Kellogg et al.
6,006,772 A 12/1999 Zheng
6,059,912 A * 5/2000 Kellogg ..... B65F 1/00 156/217
D427,402 S 6/2000 Kellogg et al.
6,092,544 A 7/2000 Zheng
D431,361 S 10/2000 Kellogg et al.
D433,810 S 11/2000 Kellogg et al.
D438,009 S 2/2001 Kellogg et al.
6,212,801 B1 4/2001 Kellogg et al.
6,220,998 B1 4/2001 Kellogg et al.
6,269,826 B1 8/2001 Zheng
D449,447 S 10/2001 Kellogg et al.
6,390,111 B2 5/2002 Zheng
D461,638 S 8/2002 Kellogg et al.
RE37,924 E 12/2002 Kellogg et al.
6,494,335 B1 12/2002 Kellogg et al.
6,527,136 B1 3/2003 Sabounjian
6,575,185 B2 6/2003 Zheng
RE38,591 E 9/2004 Kellogg et al.
6,901,940 B2 * 6/2005 Zheng ..... E04H 15/40 135/126
6,948,632 B2 9/2005 Kellogg et al.
6,997,338 B2 2/2006 Sabounjian
D519,280 S 4/2006 Kellogg et al.
7,066,647 B2 6/2006 Peska
7,131,223 B2 11/2006 Krotts et al.
D536,872 S 2/2007 Kellogg et al.
D547,950 S 8/2007 Kellogg et al.
D551,452 S 9/2007 Kellogg et al.
D555,905 S 11/2007 Kellogg et al.
D601,800 S 10/2009 Kellogg et al.
D610,352 S 2/2010 Kellogg et al.
D612,117 S 3/2010 Krotts et al.
D625,891 S 10/2010 Krotts et al.
7,845,507 B2 12/2010 Kellogg et al.
8,127,956 B2 3/2012 Krotts et al.
D661,900 S 6/2012 Krotts
D680,329 S 4/2013 Krotts
D711,107 S 8/2014 Krotts
D721,232 S 1/2015 Krotts
D728,940 S 5/2015 Krotts
D739,656 S 9/2015 Krotts
2001/0020618 A1 * 9/2001 Kellogg ..... D06F 95/004 220/9.2
2002/0112753 A1 * 8/2002 Louie ..... E04H 15/006 135/125
2002/0144997 A1 * 10/2002 Mendoza ..... D06F 95/002 220/9.2
2003/0189044 A1 * 10/2003 Kellogg ..... D06F 95/004 220/9.2
2003/0235349 A1 * 12/2003 Ricahrdson, Jr. .. B65D 88/1618 383/16
2004/0089660 A1 * 5/2004 Zaytoune ..... B65D 11/186 220/9.2
2006/0186119 A1 * 8/2006 Zheng ..... D06F 95/002 220/9.2
2009/0223954 A1 * 9/2009 Kellogg ..... D06F 95/002 220/6
2010/0018968 A1 * 1/2010 Sabounjian ..... A45C 7/0077 220/9.2
2011/0058375 A1 * 3/2011 Zheng ..... A63B 9/00 362/253
2011/0103719 A1 * 5/2011 Wang ..... B65D 33/02 383/105
2015/0308145 A1 * 10/2015 Roubanis ..... A45C 3/001 135/143
2015/0344170 A1 * 12/2015 Schneider ..... B65D 5/36 220/4.28
2016/0167832 A1 * 6/2016 Silverman ..... D06F 95/002 220/9.2

* cited by examiner

COLLAPSIBLE LAUNDRY HAMPER

This application claims priority under §119(e) to U.S. Provisional Application Ser. No. 62/090,946 filed on Dec. 12, 2014 and titled "Collapsible Laundry hamper", the entire contents of which are hereby incorporated by reference.

BACKGROUND OF INVENTION

This invention relates to collapsible containers, and more particularly to laundry hampers that are collapsible.

Laundry hampers are commonly used in the home to collect and store laundry for later washing. The hampers disclosed in the prior art include two basic types: free-standing containers and collapsible support frame/bag designs. The free-standing containers typically are rectangular or oval in shape and are made of a hard, non-flexible material, such as plastic or wicker. With their rigid construction, these containers take up the same amount of space whether empty, partially full, or full of laundry. Thus, they are often too bulky to fit into narrow storage closets or tight spaces in a laundry room. Furthermore, because they are not collapsible they are not easily moved from one place to another or easily stored.

Several designs of foldable hampers exist. These hampers typically include a relatively heavy metallic framework that supports a separate, cloth or mesh bag that loosely hangs from the top of the framework and is removably attached thereto. While appropriate for some commercial and/or large scale applications, these prior art designs have several features that make them ill-suited for use in a home environment.

In-home use foldable hampers also exist, that include relatively light-weight materials forming a framework that supports a separate, cloth or mesh bag that hangs loosely from the top of the framework, or is attached to the framework all the way around.

SUMMARY OF INVENTION

According to one aspect of the present invention, a collapsible container, such as a laundry hamper, which includes an outer liner and an inner liner and is readily portable and stowable is described.

In some embodiments, the collapsible container is provided having an outer liner defining a top, a bottom and vertical sides and an inner liner defining a plurality of sides corresponding to the vertical sides of the outer liner. The inner liner is attached to the outer liner at least at one of the top and the bottom of the outer liner, and each side of the inner liner defines a top edge, a bottom edge, and two side edges which extend vertically. A sleeve is attached to a portion of each of the edges of the inner liner at the top, bottom, and sides thereof. The sleeves define substantially circular tubes. A flexible frame is located between the outer liner and the inner liner and disposed within the plurality of sleeves to provide a flexible support and permits collapse and/or folding of the container.

In some embodiments, the inner liner defines four sides, the four sides defining four corners, and a single sleeve is attached to the edge of the sides at the corners, such that two adjacent sides of the container, at the corners, share a single sleeve, i.e., one sleeve for one corner and two sides of the inner liner.

In some embodiments a seam is provided to fixedly attach the inner liner to the outer liner at the top of the outer liner. In further embodiments, one or more handles are located at the top of at least one of the inner liner and the outer liner to provide easy portability to the container.

In some embodiments the flexible frame comprises four loops. When four loops compose the frame, vertical portions of two adjacent wire loops are disposed within a single sleeve along the sides of the inner liner, such that two wire loops share a single sleeve on the vertical portions of the container.

In some embodiments, the outer liner defines an open top and a closed bottom and the inner liner defines an open top and an open bottom, such that the container defines an open top for depositing and removing items, such as laundry, but has a solid/closed bottom to define a container to hold the items. Further, the open bottom of the inner liner may be fixedly attached to the closed bottom of the outer liner, such that the inner liner does not cover the bottom surface of the container.

Some embodiments described herein provide a flexible frame that is configured to enable collapse of the container from an expanded state to a collapsed state and/or to a storage state.

Other aspects and advantages of the invention will be apparent from the following description and the appended claims.

DETAILED DESCRIPTION

Figure 1:
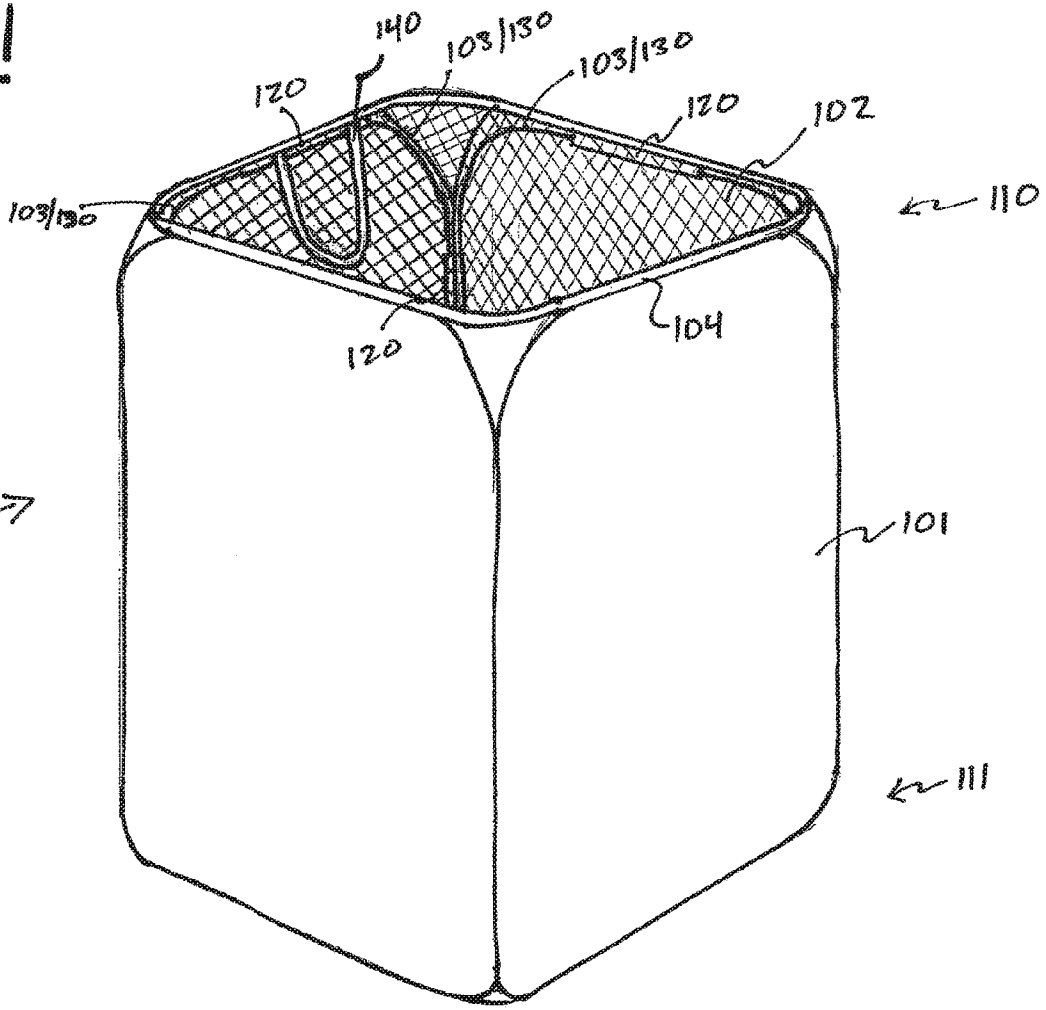
FIG. 1 is a perspective view of an embodiment of a collapsible laundry hamper.

It is to be understood that the following disclosure provides different embodiments, or examples, for implementing different features of various embodiments of the invention. Specific examples of components and arrangements are described below. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Hereinafter, an exemplary embodiment of the present disclosure will be discussed with reference to the drawings.

Figure 2:
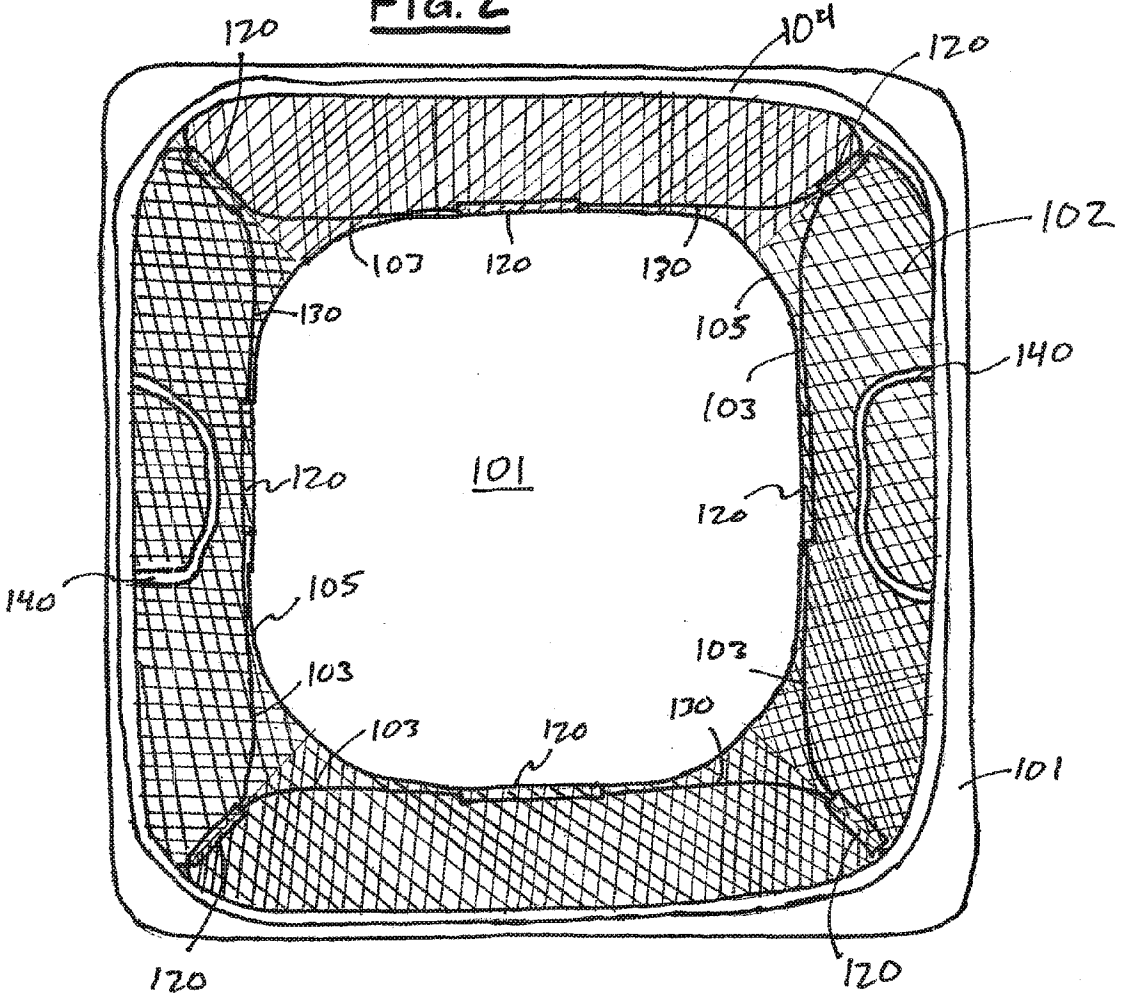
FIG. 2 is a top plan view of the collapsible laundry hamper of FIG. 1.
Figure 3:
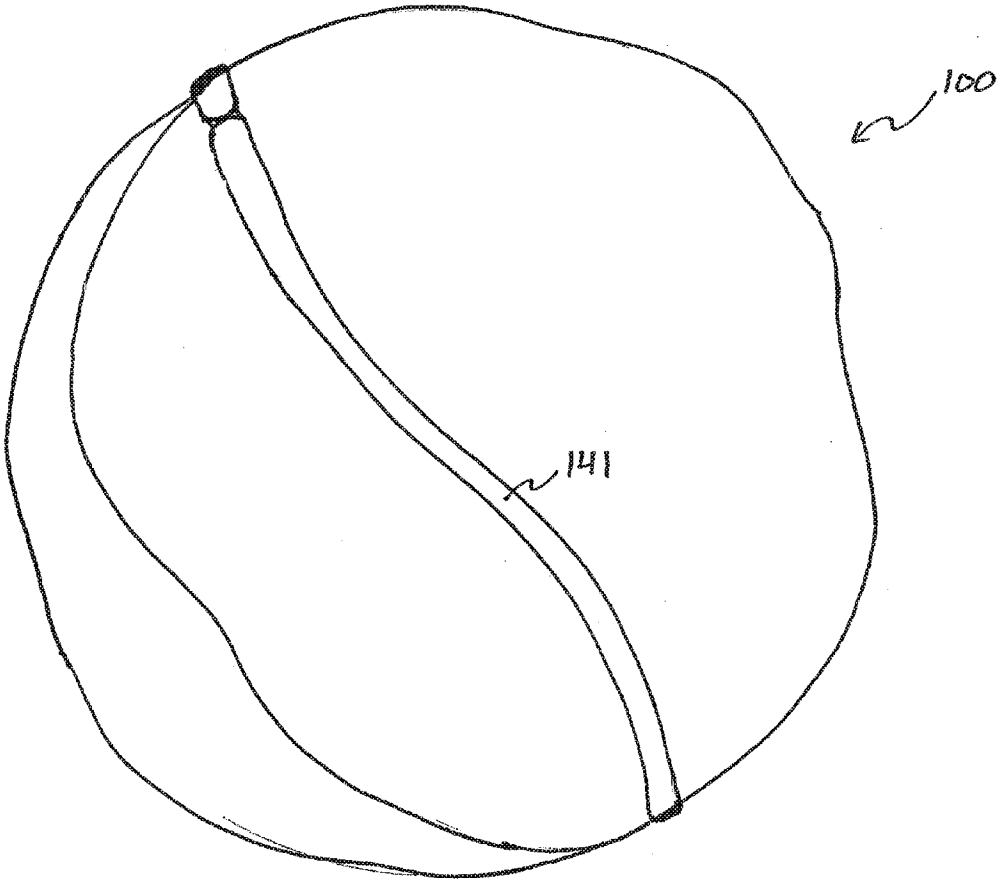
FIG. 3 shows the collapsible laundry hamper of FIG. 1 in the collapsed state.

Referring to FIGS. 1-4, a collapsible laundry hamper 100, is shown, with a top portion 110 and a bottom portion 111. FIGS. 1 and 2 shown the hamper 100 in an expanded or free-standing state and FIG. 3 shows the hamper 100 in a collapsed, storage state.

Hamper 100 includes an outer liner 101 and an inner liner 102. The outer liner 101 defines a bag with an open top and a solid or closed bottom. As shown, the inner liner 102 defines four panels defining an open top and an open bottom. The outer liner 101 and the inner liner 102 are fixedly attached to each other at at least one end, such as by sewing, glue, Velcro™, or other type of attachment means, or combinations thereof, as discussed herein. As shown in the embodiment of FIG. 1, outer liner 101 and inner liner 102 are attached at the top portion 110 of the hamper 100 by a seam 104 which is sewn such that the seam 104, the top of the inner liner 102, and the top of the outer liner 101 are all sewn together and form a sealed or closed top edge. Further, as shown in the embodiment of FIGS. 1 and 2, the inner liner 102 is attached to the bottom portion 111 of the hamper 100 by a seam 105 and fixedly attached to the outer liner 101. For example, the bottom portion of the panels of the inner liner 102 are sewn to the closed/solid bottom of the outer liner 101 at seam 105. The inner liner 102, in some embodiments, is only attached to the outer liner 101 at the top and bottom portions, such that a free and/or open space is defined between the inner liner 102 and the outer liner 101.

As noted, in this exemplary embodiment, the inner liner 102 defines four sides or panels, with an open top, at the top portion 110, and an open bottom, at the bottom portion 111. The open top and bottom of the inner liner 102 are attached to the open top of the outer liner 101 and to the closed bottom of the outer liner 101, respectively. The inner liner 102 defines a mesh or solid liner having four panels or sides formed from a fabric or other similar material, such as nylon, rayon, polyester, cotton, denim, polyester/cotton blend etc. and/or combinations thereof. The outer liner 101 defines a mesh or solid liner, for example made from nylon, rayon, polyester, cotton, denim, polyester/cotton blend, etc. and/or combinations thereof. The outer liner 101 may be water resistant or water proof, and may be formed from a material that provides such properties and/or may be treated to provide these properties. In an alternative embodiment, the inner liner 102 may be closed at the bottom, such that the mesh liner covers the bottom of the hamper 100.

The hamper 100 also includes a frame 103, which provides structure to the hamper 100 and is configured to support and retain the outer liner 101 and the inner liner 102. In this exemplary embodiment, the frame 103 is a flexible frame that is light-weight, bendable, and collapsible and may be formed from flexible metal wires, composites, plastics, and/or other materials. The frame 103 in some embodiments is formed from four separate wire loops, as discussed below. Alternatively, different constructions of the frame 103 are possible, such as a continuous wire frame, two figure-eight loops of wire, or other similar structures that provide support for a hamper forming a four-sided, circular, or other geometric shaped structure, such as a squared frame.

As shown in the embodiments of FIGS. 1 and 2, the frame 103 in an expanded state forms the hamper 100 into a free-standing hamper, such that laundry or other items can be held within the hamper 100. In FIG. 3, the frame 103, and hamper 100, is shown in the fully collapsed, storage state. The frame 103 provides sufficient structural and elastic support to free-stand, but provides a low weight, such that the weight of the frame 103, and hamper 100, does not significantly increase the weight of a load of laundry held within the hamper 100. Further, this allows the hamper 100 to be light-weight when unfilled and/or in the collapsed state, for easy portability and storage.

Figure 4:
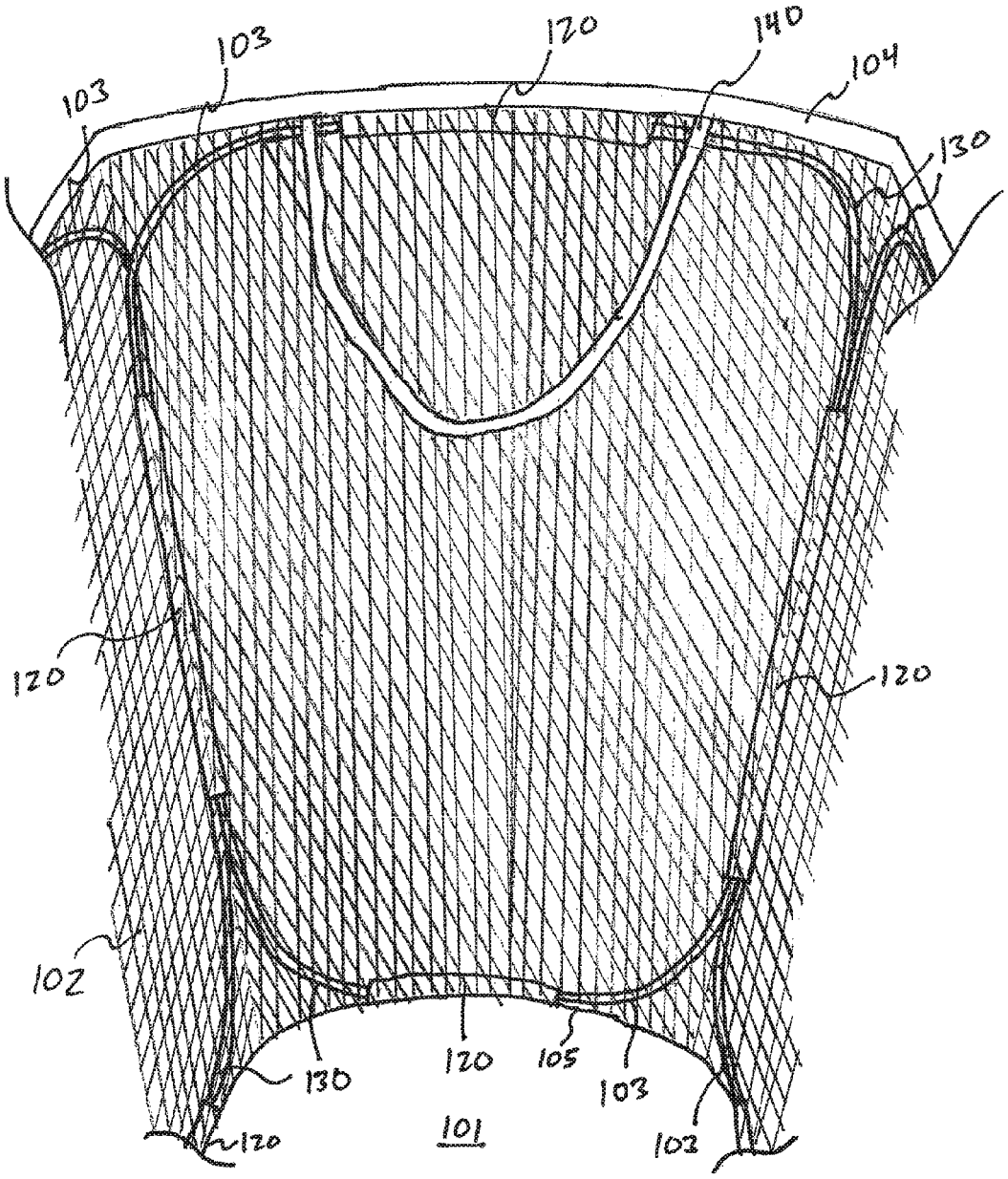
FIG. 4 shows a partial interior view of the collapsible laundry hamper of FIG. 1.

Referring to FIG. 4, the frame 103 may be formed from four rounded or curved loops 130, with each loop defining a top, a bottom, a right side, and a left side with the corners thereof curved. Each loop 130 of frame 103 may be attached to inner liner 102 by means of one or more sleeves 120. For example, as shown in FIG. 4, a loop 130 may fit within sleeves 120 that are fixedly secured to the inner liner 102, such as by sewing, glue, Velcro™, or other types of securing means. As shown, a sleeve 120 is provided at the top, the bottom, and both sides of the inner liner 102, and the corresponding portions of the loop 130 fit within and are movably and slidably retained within each sleeve 120. In this embodiment, the sleeves each extend over a portion of the inner liner 102, but do not extend entirely around an exterior or edging surface of the inner liner 102 such that only four vertical sleeves, four sleeves at the top, and four sleeves at the bottom are required to retain and house the frame 103. As such, the frame 103 is exposed at the corners of the inner liner 102, i.e., the points of transition of the loop 130 from the side to the top, the top to the side, the side to the bottom, and the bottom to the side. Advantageously, this permits reduced and/or minimal materials to be used in forming the hamper 100.

Furthermore, each adjacent side or panel of the inner liner 102 may share a sleeve 120, thereby having only one sleeve 120 at each of the four vertical corners of the expanded hamper 100, as shown in FIGS. 1 and 2. The shared sleeve 120 may be sewn or otherwise fixedly attached to the edges of each of two adjacent sides or panels of inner liner 102, as described above, with the sleeve 120 disposed between the inner liner 102 and the outer liner 101, i.e., in the free or open space between the liners 101 and 102. Furthermore, in this construction, two adjacent sides of two adjacent loops 130 of the frame 103 may pass through a single sleeve 120. In contrast, at the top and bottom of the inner liner 102 a single sleeve 120 may retain the top and the bottom of a single loop 130 of the frame 103.

As noted above, the seam 104 at the top of the hamper 100 may fixedly attach the top of inner liner 102 and the top of outer liner 101 together, such that a closed seam is achieved. Further, seam 105, at the bottom of the hamper 100, fixedly attaches the bottom of inner liner 102 and the bottom of outer liner 101 together, such that a closed seam is achieved. Because seam 104 and seam 105 connect inner liner 102 and outer liner 101 at the top and bottom, there is no need to have the two liners connect at any other portions or locations. However, in some embodiments, inner liner 102 and outer liner 101 may be connected at other locations in addition to or other than the top and/or bottom. Further, although described herein as a fixed connection between the inner liner 102 and the outer liner 101, those skilled in the art will appreciate that other types of connections, such as attachable/detachable connections can used, without departing from the scope of the disclosure. For example, the inner liner 102 can be removably attached to the outer liner 101 by Velcro™, ties, snaps, buttons, or other types of removable connecting means, or fixed connecting means including sewing, glue, etc.

As shown in FIGS. 1 and 2, the seam 104 may also include one or more handles 140. Handles 140 allow for the hamper 100 to be easily carried by a user. Although shown as attached to the seam 104, handles 140 can be secured to the inner liner 102, the outer liner 101, or combinations thereof, without departing from the scope of the disclosure. Additionally, additional handles may be provided to assist in carrying the hamper 100 when in the fully collapsed, storage state.

An optional elastic 141 may be fixedly secured to an exterior surface of the outer liner 101, as shown in FIG. 3. The elastic 141 may be an elastic cloth, rubber, or other elastic means. The elastic 141 allows for the hamper 100 to be secured in the collapsed state, to prevent the hamper 100 from expanding and to maintain a collapsed or storage state of the hamper 100. Although described as an elastic 141, other types of securing means can be used. For example, a Velcro™ strap, snaps, ties, buttons, etc, may be used to secure the hamper 100 in the storage state. In addition, or alternatively, a bag or other type of closure or container can be used to house the hamper 100 in the storage state.

Turning now to the process of collapsing the hamper 100, the frame 103, as noted above, is flexible. To collapse the hamper 100, an edge or corner of the hamper 100, when in the expanded or free-standing state, can be pushed or urged toward the opposing edge or corner, diagonally opposite thereof. This allows the hamper 100 to fold into a relatively flat or partially collapsed state, with two loops 130 of frame 103 stacked on top of each other, forming a flat hamper 100 with two stacks of two loops 130. For example, the two flattened portions of the hamper 100 form a substantially figure-eight shape with the stacked loops 130. Then, the hamper 100 can be folded again, such that all four loops 130 of frame 103 are stacked on top of each other into a fully collapsed state.

The flattened hamper 100 in the fully collapsed state thus defines a substantially rectangular shape with rounded corners, defined by the rounded corners of the frame 103. To then adjust the hamper 100 into a storage state, the frame 103 can be twisted in a semi-helical manner to form smaller circles of the frame 103, similar to a spring coil. Because the frame 103 is flexible, the frame can easily form the circular structure. Once wound into a small circular shape, the elastic 141 can be used to wrap around the fully collapsed hamper 100 in the storage state to prevent the hamper 100 from elastically, and potentially unexpectedly, expanding back to the collapsed state, i.e., back into the flattened fully collapsed or partially collapsed states, or even expanding to the fully expanded or free-standing state.

While the disclosure has been presented with respect to a limited number of embodiments, those skilled in the art, having benefit of this disclosure, will appreciate that other embodiments may be devised which do not depart from the scope of the present disclosure. Accordingly, the scope of the invention should be limited only by the attached claims.

We claim:

1. A collapsible container, comprising:

an outer liner defining a top, a bottom and four vertical sides extending between the top and bottom of the outer liner;

an inner liner defining four sides corresponding to the vertical sides of the outer liner, the inner liner attached to the outer liner at least at one of the top and the bottom of the outer liner, wherein each said side of the inner liner comprises a top edge, a bottom edge, and two side edges which extend vertically;

a plurality of tubular sleeves between the inner liner and the outer liner, wherein at least one tubular sleeve is located at each of the four corners formed by adjacent vertical sides; and flexible frames located between the outer liner and the inner liner on each vertical side, wherein the flexible frames on adjacent vertical sides both pass through the at least one tubular sleeve located at each of the four corners.

2. A collapsible container as defined in claim 1, further comprising a seam configured to fixedly attach the inner liner to the outer liner at the top of the outer liner.

3. A collapsible container as defined in claim 1, further comprising one or more handles located at the top of at least one of the inner liner and the outer liner.

4. A collapsible container as defined in claim 1, wherein the flexible frame comprises four loops defining top, bottom, and vertical portions.

5. A collapsible container as defined in claim 4, wherein vertical portions of two adjacent loops both pass through a single tubular sleeve along the sides of the inner liner.

6. A collapsible container as defined in claim 1, wherein the outer liner defines an open top and a closed bottom and the inner liner defines an open top and an open bottom.

7. A collapsible container as defined in claim 6, wherein the open bottom of the inner liner is fixedly attached to the closed bottom of the outer liner.

8. A collapsible container as defined in claim 1, wherein the flexible frame is configured to enable collapse of the container from an expanded state to a collapsed state.

9. A collapsible container as defined in claim 1, wherein the tubular sleeve is fixedly attached to the inner liner.

* * * * *